United States Patent [19]

Bell

[11] 4,378,068

[45] Mar. 29, 1983

[54] COMPOSITE CARDED DISPLAY PACKAGE WITH COVER

[75] Inventor: Richard L. Bell, Exton, Pa.

[73] Assignee: Container Corporation of America, Chicago, Ill.

[21] Appl. No.: 261,664

[22] Filed: May 7, 1981

[51] Int. Cl.[3] ..... B65D 73/00

[52] U.S. Cl. ..... 206/461; 206/470; 206/806; 229/93

[58] Field of Search ..... 206/461, 462, 467, 470, 206/486, 806, 446, 0.82; 229/93

[56] References Cited

U.S. PATENT DOCUMENTS

| | | | |
|---|---|---|---|
| 596,563 | 1/1898 | Young | 229/93 |
| 3,025,958 | 3/1962 | Snape | 206/806 |
| 3,082,902 | 3/1963 | Kimbrough, Jr. | 206/806 |
| 4,109,790 | 8/1978 | Gottschlich | 206/446 |
| 4,183,432 | 1/1980 | Lemaire | 206/0.82 |
| 4,290,523 | 9/1981 | Wallace | 206/0.82 |

*Primary Examiner*—William T. Dixson, Jr.

*Attorney, Agent, or Firm*—Richard W. Carpenter; Davis Chin

[57] ABSTRACT

A composite carded display package including a paperboard advertising panel having at one end thereof an integral, hollow, paperboard and plastic pocket member for holding a packaged article and a cover for said pocket member.

9 Claims, 15 Drawing Figures

COMPOSITE CARDED DISPLAY PACKAGE WITH COVER

BACKGROUND OF THE INVENTION

1. Field Of The Invention

This invention relates generally to carded display packages, and more particularly to a composite carded display package which includes a generally flat advertising card member having formed integrally therewith a hollow pocket member, comprised of paperboard and molded plastic, for holding an article to be displayed, and a cover for said pocket member. 2. Description Of The Prior Art A state of the art search directed to the subject matter of this application uncovered the following patents: U.S. Pat. Nos. 2,866,544; 2,903,139; 2,990,082; 3,023,923; 3,127,698; 3,179,246; 3,275,274; 3,286,835; 3,322,269; 3,436,008; 3,459,359; 3,645,384; 3,657,855; 3,698,551; 3,770,120; 3,785,544; 3,908,827; 3,910,410; 4,029,202; 4,076,790; 4,092,201; 4,109,821.

None of the prior art patents uncovered in the search disclosed a composite and paperboard plastic carded display package similar to that of the present invention wherein a card member has a composite pocket member, with a removable cover, integrally formed with and extending from one end thereof for holding a packaged article.

SUMMARY OF THE INVENTION

It is an object of the invention to provide an improved visual carded package adapted to stand on a shelf with similar packages or to be suspended from a display rack.

Another object of the invention is to provide an improved visual carded display package formed of paperboard and plastic by an insert molding process.

A more specific object of the invention is to provide, in a display package of the type described, an arrangement which includes a generally flat paperboard display or advertising card member having formed integrally at one end thereof a composite paperboard and plastic pocket member adapted to receive and retain a packaged article therein and which has a removable cover.

These and other objects of the invention will be apparent from an examination of the following description and drawings.

It will be understood that for purposes of clarity certain elements may have been intentionally omitted from certain views where they are believed to be illustrated to better advantage in other views.

DESCRIPTION OF THE PREFERRED EMBODIMENTS

Figure 1:
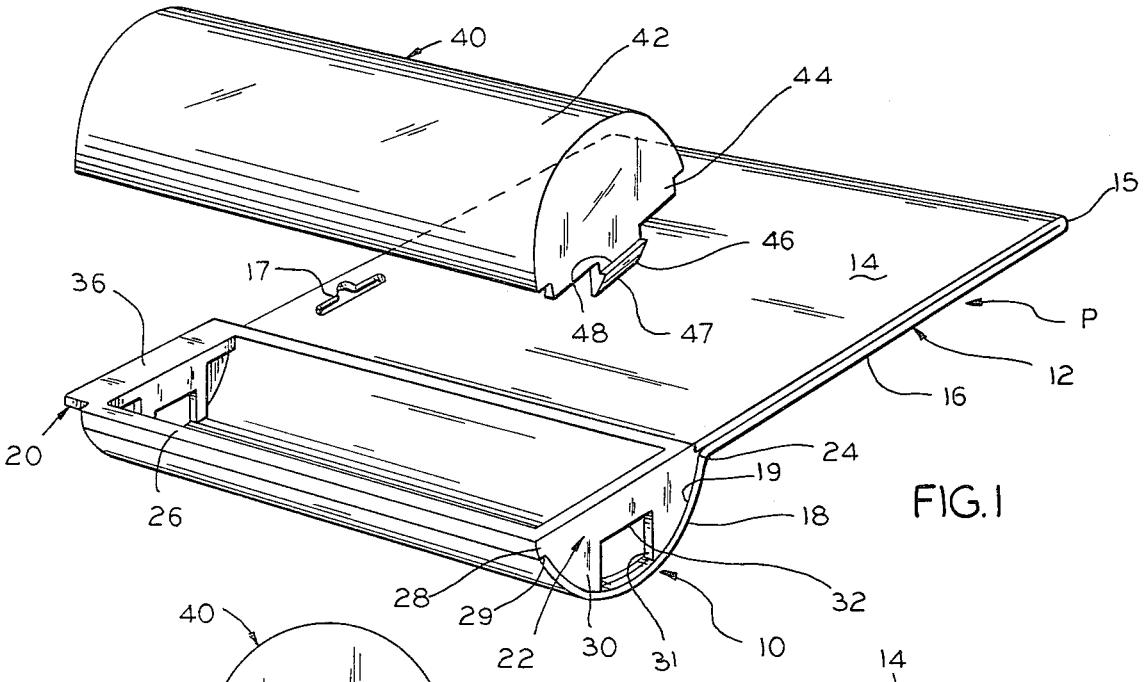
FIG. 1 is a perspective view of a composite carded display package embodying features of the invention.
Figure 2:
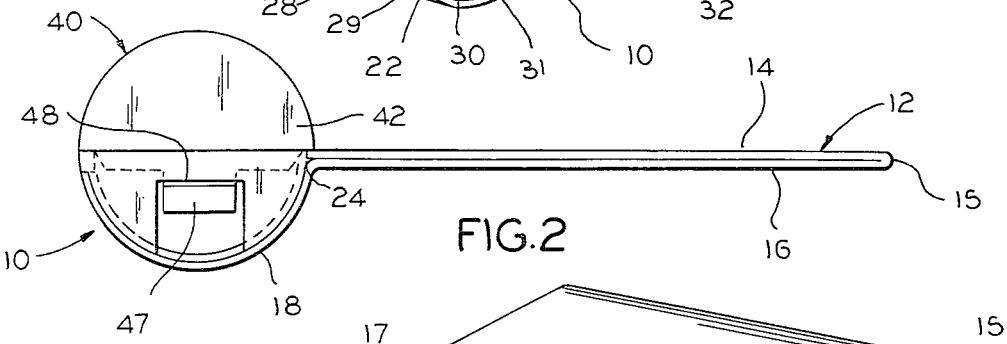
FIG. 2 is a side elevational view of the structure illustrated in FIG. 1.

Referring now to the drawings for a better understanding of the invention, and particularly to FIGS. 1 and 2, it will be seen that the invention comprises a novel display package indicated generally at P which is adapted to hold and display a packaged article (indicated generally at A in certain views).

As best seen in FIG. 1, display package P includes a hollow, article holding or pocket member, indicated generally at 10, which is formed integrally with and projects from a relatively flat advertising or card member 12.

Card member 12 may include a pair of relatively flat paperboard front and rear panels 14 and 16, respectively, which have corresponding rear edges foldably joined to each other along a fold line 15, and which are disposed in face-to-face relation.

In order to permit display package P to be suspended from a rack in a retail store for display purposes card member 12 may be provided with an opening 17 extending therethrough which is located in such a position as to permit the package to hang level when it is filled with a packaged article.

At its forward end rear panel 16 is provided with an integral extension 18 projecting therefrom which may be generally semi-cylindrical in shape to define a channel 19.

Thus, extension 18 of rear panel 16 serves as a shell in which to receive and be bonded to a similarly contoured liner 20 which is formed of molded plastic.

The general construction of this package is accomplished in the same manner as the article described in U.S. Pat. No. 3,397,814. In this type of construction the paperboard portion of the package is inserted into a mold, and then plastic is inserted to form the liner of the pocket member and at the same time bond the liner to the shell and to portions of the display card member of the package in order to form a composite package.

Still referring to FIG. 1, it will be seen that liner 20 includes a preferably cylindrically shaped body portion 22 having at its rear edge an integral anchor or wedge-shape portion 24 which extends between the adjacent edges of the card member front and rear panels 14 and 16. This is accomplished when the package is formed in a mold, as previously described, and helps secure and strengthen the relationship of the pocket member to the card member.

Liner 20 is provided with a rim portion 26 having adjacent its forward edge a shoulder or abutment 28 which presents a recess 29 for receiving the forward portion of shell 18 of the pocket member.

In the embodiment illustrated in FIGS. 1 and 2 it will be noted that the pocket member is generally semi-cylindrical in shape; although it must be understood that the pocket member can assume any one of many various shapes depending upon the shape of the article to be packaged.

In order to close pocket member 10, there may be provided a cover 40 of molded plastic material.

As best seen in FIG. 1, cover 40 is generally semi-cylindrical in shape and includes a body 42 with end walls 44 which extend a slight distance beyond the remainder of the body 42 and which have formed integrally therewith and project therefrom locking or latching lugs 46.

Lugs 46 have inclined cam surfaces 47 and present abutments 48. Lugs 46 are adapted to be received in aligned openings 31 of liner end walls 30 with abutments 48 engaging lock edges 32 presented by end walls 30 at the edges of openings 31 to provide a latching arrangement which is difficult to unlatch.

In order to remove cover 40 and to provide access to the article and make it easier to move the article from the pocket member after cover 40 has been removed one of the end walls 30 of liner 20 may be provided with an integral outwardly extending flange 36 which may be easily broken off to provide access to the packaged article and permit it to be slipped out of the end of the pocket member. Thus, the package is, to some extent, tamper-proof, in that it is difficult to remove the cover from the liner or the packaged article from the pocket member without destroying the integrity of the package.

Figure 3:
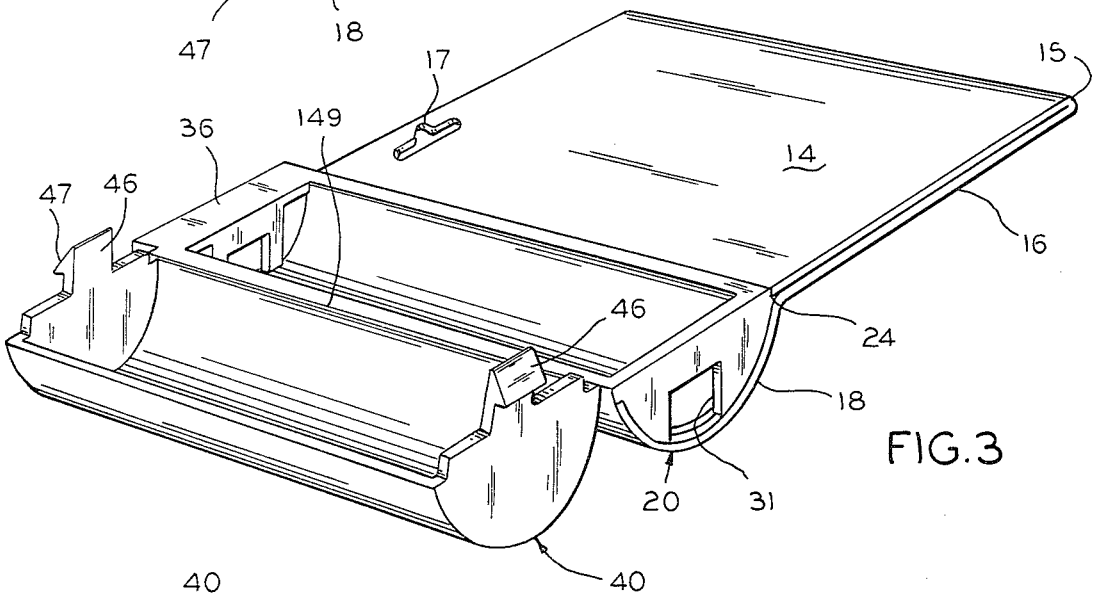
FIGS. 3 and 4 are views similar to FIGS. 1 and 2, but illustrated a modified form of the invention.
Figure 4:
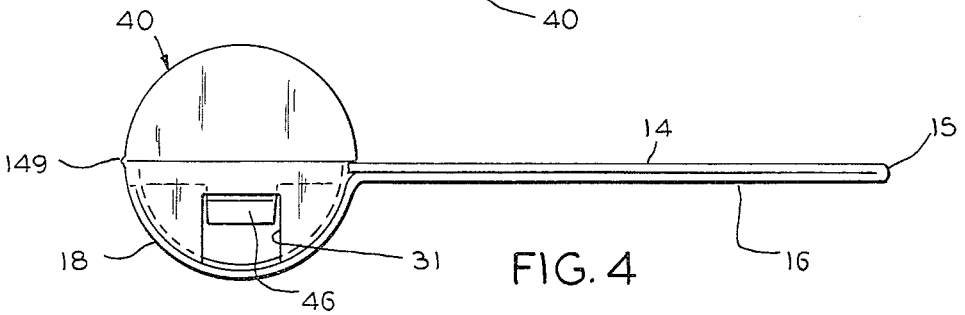

Now referring to FIGS. 3 and 4, it will be seen that a slightly modified form of the invention is illustrated therein. In this and the other embodiments hereinafter described those portions of the structure corresponding to portions of structure of the previously described embodiment are indicated by the same or similar numerals.

In FIG. 3 the embodiment is basically the same as that illustrated in FIGS. 1 and 2, except that cover 40 is secured to pocket member liner 20 by an integral hinge 149 which is formed as the cover is molded right with the pocket and card members of the package. Cover 40 is, of course, all plastic; whereas pocket member 10 is a composite of paperboard and plastic, as in the previous embodiment.

Figure 5:
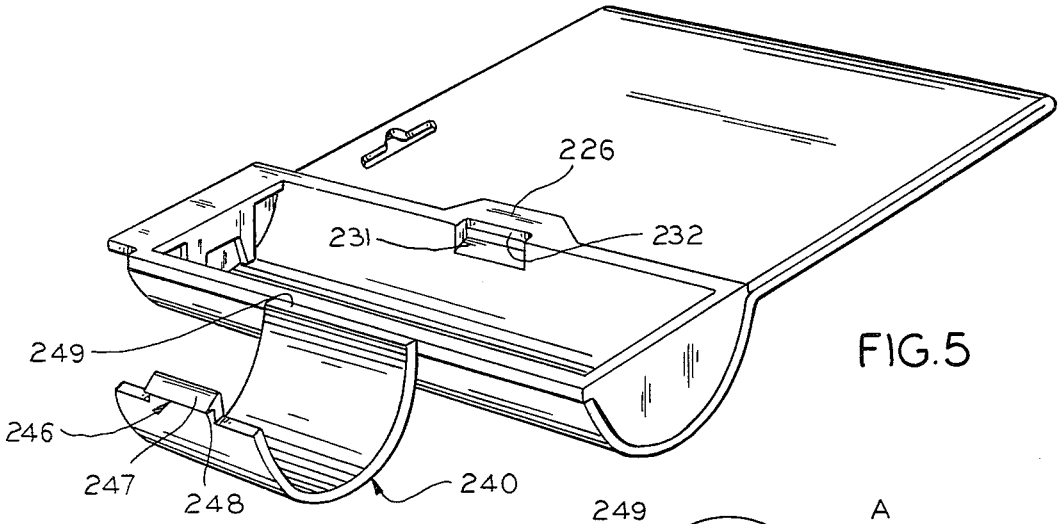
FIGS. 5 and 6 are views similar to FIGS. 1 and 2, but illustrate another modified form of the invention.
Figure 7:
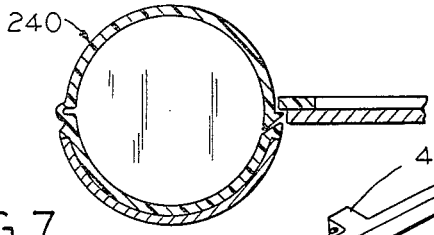
FIG. 7 is a view similar to FIG. 6, but illustrating the package with the pocket member cover shown closed.
Figure 6:
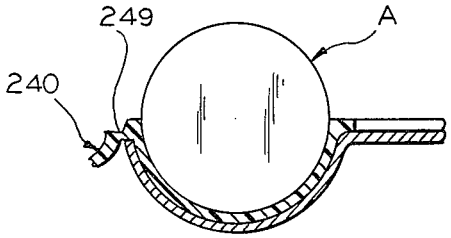

Now referring to FIGS. 5–7 it will be seen that another slightly modified form of the invention is shown.

In this embodiment the structure is very similar to that illustrated in FIGS. 3 and 4. Here again, the cover 240 is formed with and hingedly attached to pocket member liner 20.

However, in this embodiment cover 240 is much narrower than liner 20, so that it only covers a center portion of the pocket member.

Also, in this embodiment the latch structure is slightly different from that of the previous embodiments. Here the forward edge of cover 240 is provided with an integral locking lug 246 having a cam surface 247 and an abutment or lip 248 adapted to engage ledge 232 in recess 231 presented by rim 226 of liner 20.

Figure 8:
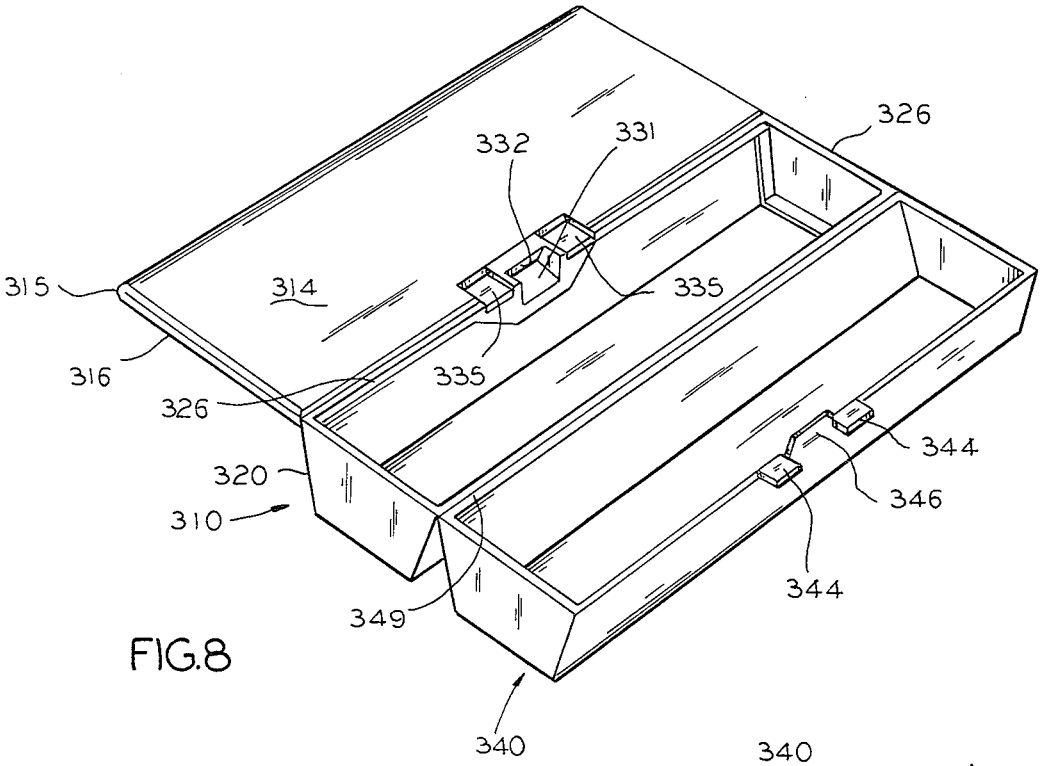
FIGS. 8 and 9 are views similar to FIGS. 1 and 2, but illustrate yet another form of the invention.
Figure 9:
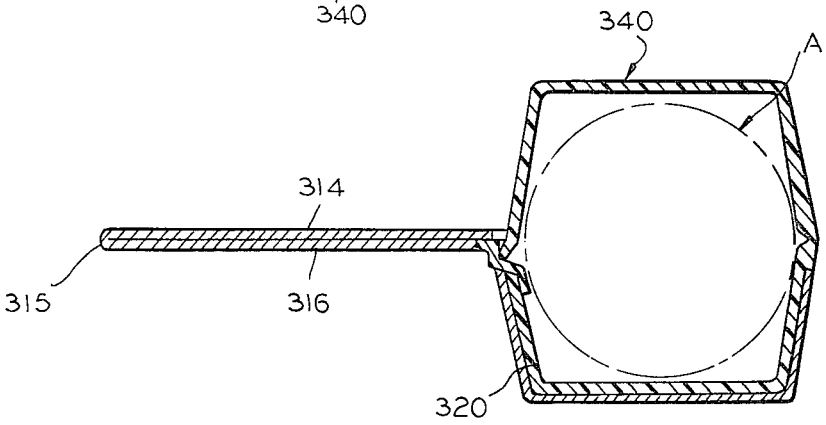

Now referring to FIGS. 8 and 9, it will be seen that another embodiment of the invention is shown.

In this embodiment the structure is quite similar to that of the embodiment illustrated in FIGS. 3 and 4, except that the configuration of the pocket member 310 and cover 340 is generally hexagonal rather than semi-cylindrical.

Also, in this embodiment the latch mechanism is located in the center of the pocket member, as in the embodiment of FIGS. 5–7, rather than at the ends of the pocket member, as in the embodiments of FIGS. 1–4.

In this embodiment lock lug 346 of cover 340 is disposed to extend under and engage lock ledge 332 of opening 331 in liner 320. Also, to assist in alignment and locking, there are provided a pair of tabs 344 projecting from cover 340 adjacent locking lug 346, and these tabs 344 are adapted to be received within related recess 335 presented by liner rim 326.

Figure 15:
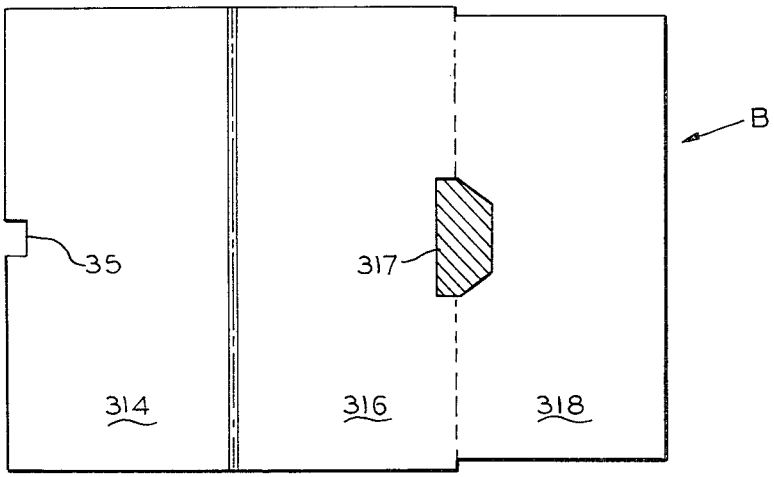

In FIG. 15, there is illustrated the blank of foldable paperboard employed to form the paperboard portion of the package illustrated in FIGS. 8 and 9. In FIG. 15 the front panel, the rear panel, and the shell are designated by numbers 314, 316, and 318, respectively, with panels 314 and 316 presenting openings 315 and 317, respectively, to accommodate the latch or locking mechanism previously described.

In FIGS. 10–13, yet another embodiment of the invention is illustrated.

Although this embodiment of the invention contains many features that are common to the other embodiments, it also includes certain additional features.

Figure 14:
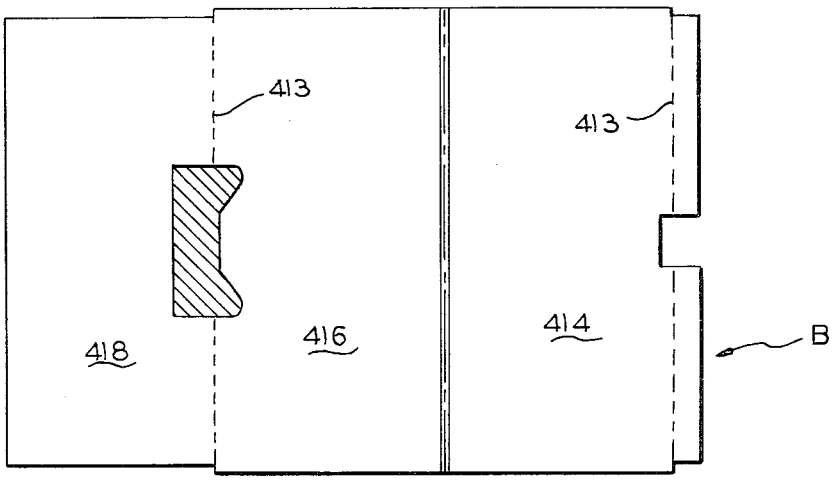
FIGS. 14 and 15 are plan views of the blanks from which the card members of FIGS. 10 and 8, respectively, may be formed.

In this embodiment, card member 412 is formed from the blank B of paperboard, illustrated in FIG. 14, which includes front panel 414, rear panel 416, and shell 418.

Figure 12:
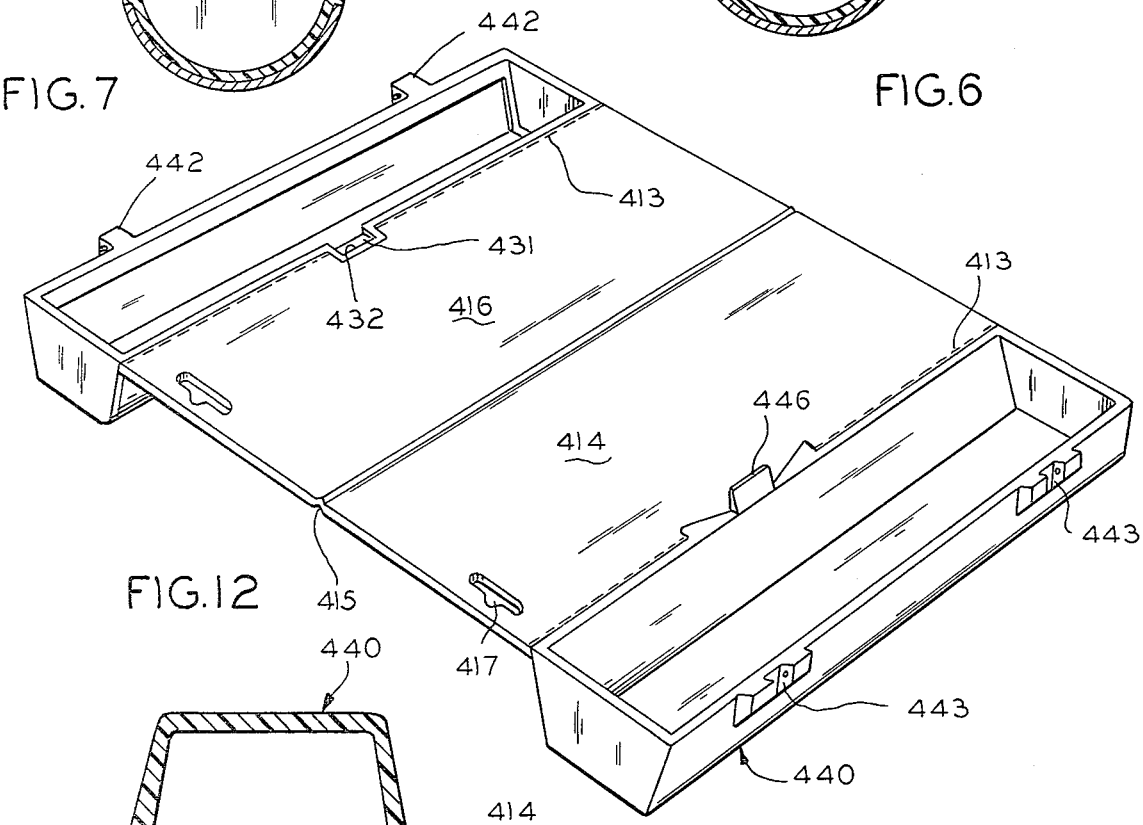
FIG. 12 is a view similar to FIG. 10, but showing the package in the position in which it is originally formed, before it is assembled.
Figure 11:
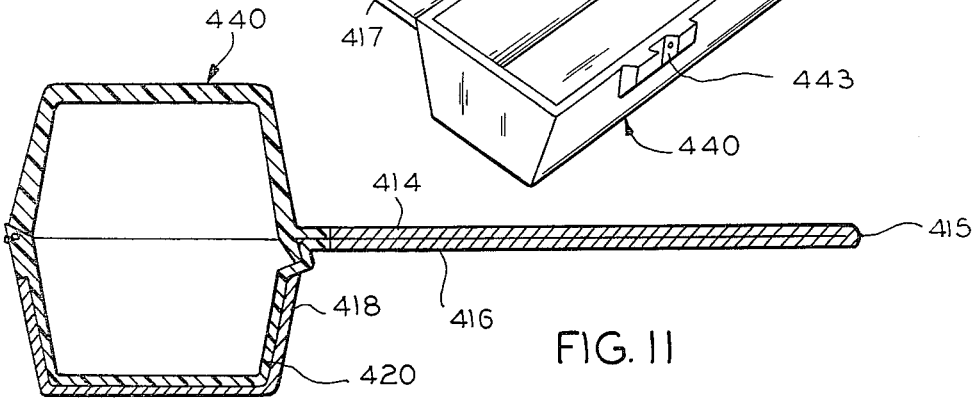
FIGS. 10 and 11 are also views similar to FIGS. 1 and 2, but illustrate yet another modified form of the invention.
Figure 10:
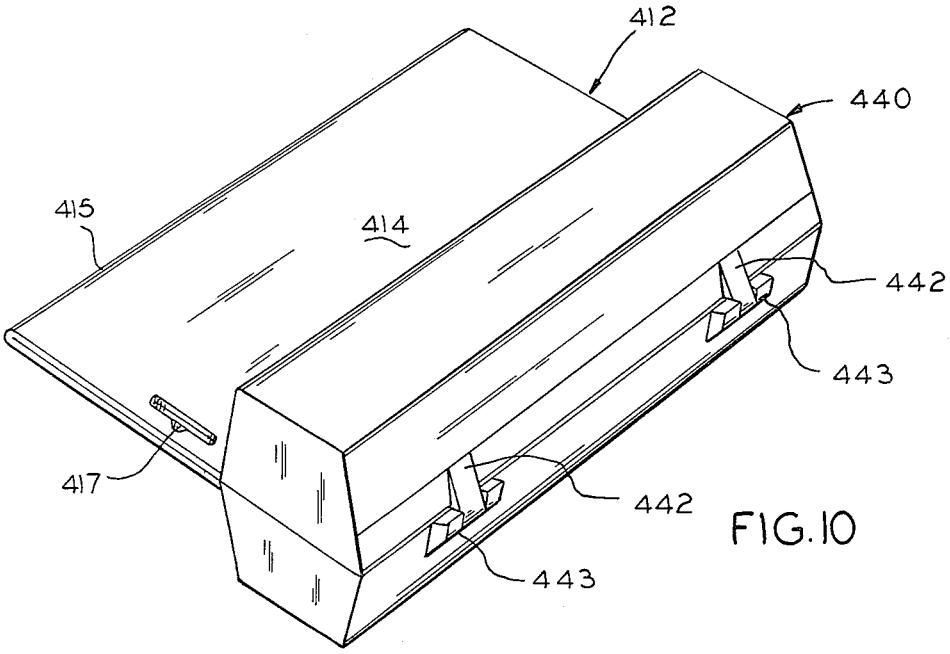
Figure 13:
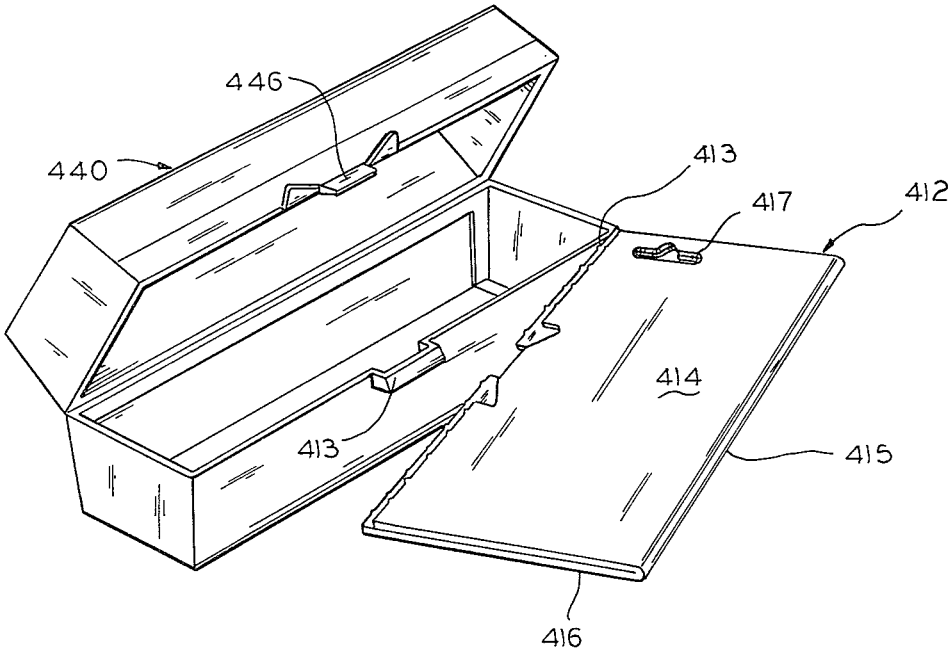
FIG. 13 is a view similar to FIG. 10, but illustrating the manner in which the card member can be removed from the pocket member.

In this embodiment, the composite package is formed in a mold in the opened condition illustrated in FIG. 12, and the front panel 414 and cover 440 thereafter folded to overlie rear panel 416 and liner 420, as shown in FIG. 10. Panels 414 and 416, which are foldably joined to each other on fold line 415, may be secured to each other in face-to-face relation in any desired manner, such as by adhesives.

It will be noted that instead of the molded integral hinge arrangement of the previous embodiments, pocket member liner 420 and cover 440 are joined by a snap lock hinge arrangement when when they are brought together. Liner 420 is provided with female hinge members 443 which receive male hinge members 442.

At the opposite side thereof cover 440 is provided with a locking lug 446 adapted to be received within a lock opening 430 in liner 420 in a similar manner to that described in connection with previous embodiments.

Also, it will be noted that card member panels 414 and 416 may be provided with perforated lines of weakness 413 which permit the entire pocket member 410 and cover 440 to be detached from the card member 412 and used as a separate case for holding the original packaged article A or any other item.

It is to be understood that in each embodiment of the invention there is provided a novel composite paperboard and plastic visual carded display package that permits an article to be attractively displayed and yet is relatively tamper-proof because in most cases it is protected by a plastic rim.

What is claimed is:

1. In a composite paperboard and plastic carded display package, the combination of:

(a) a relatively thin, generally flat advertising card member, formed of paperboard, and, extending from one end thereof, a hollow pocket member for holding a packaged article;

(b) said card member including a pair of front and rear panels, said panels having rear edges foldably joined to each other along a fold line, said front panel being disposed in face-to-face relation to said rear panel;

(c) said pocket member including:

(i) an outer paperboard shell element, formed integrally with and extending from said rear panel of said card member;

(ii) an inner plastic liner element having a contour similar to said shell element and being bonded to said shell element;

(iii) a molded plastic cover element positionable over said liner element, to retain said article in said pocket member;

(iv) said liner and cover elements being formed integrally with latching means for interlocking engagement with each other.

2. A package according to claim 1, wherein said latching means, once engaged, cannot be disengaged without destroying the integrity of one of said elements.

3. A package arrangement according to claim 1, wherein said cover element is separate from said liner element.

4. A package according to claim 1, wherein said liner and cover elements are joined to each other by integral molded hinge means.

5. A package according to claim 1, wherein said latching means are disposed at opposite ends of said elements.

6. A package according to claim 1, wherein said latching means is disposed intermediate the ends of said elements.

7. A package according to claim 1, wherein said cover element is adapted to cover only an intermediate portion of said liner element.

8. A package according to claim 1, wherein said cover and liner elements are hingedly attached to each other at a location remote from said card member.

9. A package according to claim 1, wherein said cover and liner elements are hingedly attached to each other by mechanical snap together latch means.

* * * * *